United States Patent [19]

Vidoz et al.

[11] Patent Number: 4,557,770

[45] Date of Patent: Dec. 10, 1985

[54] ALUMINUM BASE ALLOYS

[75] Inventors: Aldo E. Vidoz, Los Altos Hills; Donald D. Crooks, San Jose; Richard E. Lewis, Saratoga; Ian G. Palmer, Los Altos; Jeffrey Wadsworth, Menlo Park, all of Calif.

[73] Assignee: Lockheed Missiles & Space Company, Inc., Sunnyvale, Calif.

[21] Appl. No.: 520,896

[22] Filed: Aug. 8, 1983

[51] Int. Cl.[4] ..... C22C 21/00

[52] U.S. Cl. ..... 148/437; 148/415

[58] Field of Search ..... 420/528, 543, 544, 546, 420/549, 552, 553; 148/437, 440, 415

[56] References Cited

U.S. PATENT DOCUMENTS 1,333,965 3/1920 Fahrenwald ..... 420/528

*Primary Examiner*—R. Dean

*Attorney, Agent, or Firm*—Richard H. Bryer

[57] ABSTRACT

Aluminum base alloys characterized by low density, high elastic modulus and high strength and having a composition consisting esentially of aluminum—about 0.5 to about 4.3 weight percent lithium—about 0.02 to about 20 weight percent beryllium.

2 Claims, No Drawings

ALUMINUM BASE ALLOYS

TECHNICAL FIELD

This invention relates to improved aluminum base alloys exhibiting unusually low density, high elastic modulus and high strength.

BACKGROUND ART

Continuing efforts by the art to improve the properties of aluminum base alloys have taken several approaches.

Aluminum-lithium alloys are being developed in order to achieve low density and high elastic modulus which are characteristic of the alloys; see T. H. Sanders and E. S. Balmuth, "Aluminum-Lithium Alloys: Low Density and High Stiffness", Metal Progress, Vol. 113, No. 3, 32, 1978, and E. A. Starke, Jr., T. H. Sanders, Jr., and I. G. Palmer, "New Approaches to Alloy Development in the Al-Li System", J. Metals, 33, 1981, 24. Recently developed powder metallurgy techniques using rapidly solidified particulate are being applied in an effort to overcome problems which have been experienced with conventional ingot cast aluminum-lithium alloys, namely, segregation effects and low fracture toughness. Specifically, the rapid solidification approach is being used to (1) reduce or eliminate segregation, (2) reduce the grain size, (3) extend solid solubility of additional elements, and (4) refine the dispersoid particle size.

The characteristics of aluminum alloys roduced from rapidly solidified powders have been reviewed recently; see, J. R. Pickens, "Aluminum Powder Metallurgy Technology for High Strength Applications", J. Mats. Sci., 16, 1981, 1437 and T. E. Tietz and I. G. Palmer, "Advanced PM Aluminum Alloys", Proceedings 1981 ASM Materials Science Seminar, Advances in Powder Technology, Louisville, Ky., Oct. 1981, p. 189. Discussed in these references are high strength, aluminum-lithium alloys. These alloys typically contain 1 to 3 weight percent lithium. Various additives have been utilized in these alloys to enhance their properties. Zirconium, for example, results in a finer microstructure which helps to disperse slip, with improved ductility and toughness. Alloys containing high concentrations of zirconium, e.g. more than about 0.15 weight percent, require rapid solidification to avoid segregation of zirconium during cooling. Copper and magnesium also are added to aluminum-lithium alloys to improve strength. Rapid solidification for these alloy additions is not normally required for the concentrations of interest.

Although at their current stage of development the Al-Li-Cu-Mg-Zr alloys show improvement in properties compared to conventionally available aluminum alloys, there is still a need for more advanced aluminum alloys with better specific properties for improved structural applications. Desirable improvements include reduced density, higher modulus of elasticity, high ductility and toughness.

Beryllium-aluminum alloys containing 20 to 90 weight percent beryllium have been produced by atomizing a molten solution of aluminum in beryllium from a temperature of approximately 1370° C.; see, McCarthy et al., U.S. Pat. No. 3,644,889. These alloys, containing more than 20 weight percent beryllium, are characterized by a distinctive microstructural appearance in which the beryllium-rich phase is present in the form of generally particulate, irregularly shaped substantially continuous networks which are interspersed by the aluminum-rich phase. These alloys accordingly do not exhibit the fine microstructure features of the aluminum-lithium alloys. U.S. Pat. No. 3,644,889 discloses various strengthening agents for the aluminum phase of the composite alloy; such agents include Mg, Zn, Cu, Li, Ag, Si, Mn, Ti, Zr and others. Lithium is stated as being present up to 5.5 weight percent. Applicants, however, have determined that some of these named strengthening elements do not in fact strengthen the aluminum phase. An example is copper which is soluble in aluminum as well as in beryllium and when added to an alloy of beryllium and aluminum, it preferentially combines with beryllium and does not strengthen the aluminum phase.

Beryllium-aluminum alloys have an undesirable microstructure and are expected to exhibit low fracture toughness. Also, due to their high beryllium content they are very costly.

DISCLOSURE OF INVENTION

Briefly, in accordance with the invention, beryllium additions to aluminum-lithium base alloys result in novel alloys possessing improved properties.

More particularly, the invention relates to alloys of aluminum having amounts of lithium from about 0.5 to about 4.3 weight percent and amounts of beryllium from about 0.02 to about 20 weight percent. A preferred compositional range for the alloys of the invention is aluminum—about 0.5 to about 4.3 weight percent lithium—about 0.02 to about 10 weight percent beryllium.

BEST MODE OF CARRYING OUT THE INVENTION

Applicants have found that beryllium additions in common with zirconium additions to aluminum—lithium base alloys help refine the microstructure of the alloys and disperse slip. In addition, the beryllium additions decrease density and increase stiffness and strength. Alloys containing such beryllium additions are to be distinguished from the beryllium—aluminum base alloys of the prior art which constitute a different alloy system in which the same fine microstructure is not realized.

The maximum amount of beryllium in applicants' alloys is determined by several considerations. The beryllium second phase must be present in the form of a uniform dispersion of fine beryllium-rich particles. High concentration of beryllium in aluminum-lithium alloys will result in the presence of a coarse interconnected beryllium second phase (U.S. Pat. No. 3,644,889) which is an undesirable characteristic for the purpose of the instant invention and precludes the obtaining of the properties exhibited by applicants' alloys. High beryllium concentrations degrade properties such as ductitity and toughness and alloys containing large amounts of beryllium are expensive due to the high cost of beryllium.

In view of the above considerations, a preferred range of compositions for the aluminum-lithium-beryllium alloys of the invention is from about 0.5 to about 4.3 weight percent lithium, from about 0.02 to about 10 weight percent beryllium and the remainder consisting essentially of aluminum.

Optimization of the mechanical properties of the alloys of the invention may be achieved by the addition of other elements following state-of-the-art considerations. These will include, but not be limited to, additions to provide solid solution or dispersoid strengthening (Mg, Si, Mg+Si, Mn, Mn+Mg+Si). It has been demonstrated that copper is not a viable strengthening agent in aluminum alloys containing beryllium since it preferentially forms an intermetallic phase with beryllium. Also, small additions of selected elements such as B, Ti, B+Ti, Zr and the like may result in promoting an even finer, more homogeneous dispersion of beryllium-rich particles by promoting the nucleation of the latter from the liquid and solid states upon cooling.

Several examples are given to illustrate the preparation and characteristics of aluminum base alloys of the invention.

EXAMPLE 1

An aluminum-lithium-beyllium alloy was prepared by melt spinning using the following process. First, a master alloy of aluminum and beryllium was melted in an arc button furnace under a partial pressure of argon. The alloy button was remelted six times to assure homogeneity. The lithium was added to the master alloy button of aluminum-beryllium and alloyed together to produce the ternary alloy. An excess of about 10 percent of the total alloy content was added to compensate for evaporization losses during arc melting. [An alternative method for preparing the prealloyed composition could be by vacuum or inert gas induction melting instead of the arc button furnace.] The prealloyed buttons were then used for melt spinning using an apparatus capable of producing up to about 2 kg of ribbon per run in a controlled atmosphere and pressure. Melting was conducted in a beryllium oxide crucible inside a high density graphite susceptor heated by induction. The alloy was heated to a temperature in excess of the one required to obtain complete liquid solubility of beryllium and held for 5 to 10 minutes at this temperature. Then a beryllium oxide stopper rod closing an orifice of less than one millimeter in diameter at the bottom of the crucible was removed and at the same time the pressure was increased in the crucible to allow the molten alloy to be projected onto the melt spinning wheel. The molten alloy jet impinged on the highly polished surface of a spinning copper wheel, resulting in a thin, rapidly solidified ribbon. This alloy ribbon was collected, comminuted and cold compacted to 30–50% density and vacuum hot pressed at 480° C. and 69 MPa for ½ hour. The finished pressing, essentially with full density was then extruded at about 425° C. through a 20:1 reduction die with a 2:1 aspect ratio. The bar product was then solution heat treated at 538° C. for ½ hour, water quenched and aged at 190° C. Times and temperatures can be varied to produce the desired microstructural condition. The microstructure consisted of a relatively featureless matrix containing a homogeneous dispersion of fine particles mostly of 0.1 to 1 μm in size. The results of heat treatment showed that the material responds to age hardening in a similar way to binary alumunum-lithium alloys. This indicates that the precipitation of the $Al_3Li$ (δ') phase is not blocked by the presence of beryllium, contrary to the case of aluminum-beryllium-copper alloys in which the applicants have found that the formation of $Al_2Cu$ is inhibited by the preferential combination of the copper with beryllium.

EXAMPLE 2

An alloy containing 3.6 wt. % lithium, 9.8 wt. % beryllium balance aluminum was prepared following the procedures indicated in Example 1. The alloy exhibited a density of 2.341 g/cm$^3$ and a microstructure consisting of an age hardenable, aluminum-lithium matrix having a dispersion of fine beryllium-rich particles of submicron size, mostly below 0.5 μm in diameter. After a solutionizing heat treatment at 538° C. for ½ hour, water quenching and aging at 175° C., the alloy showed changes in hardness representative of the precipitation of $Al_3Li$(δ') as indicated in Table 1.

TABLE 1

| Rockwell B Hardness | |
|---|---|
| Time (Hours) | Hardness ($R_B$) |
| 0 | 50.0 |
| 1.0 | 75.3 |
| 4.25 | 83.0 |
| 6.0 | 84.7 |
| 8.0 | 83.3 |
| 11.0 | 82.7 |
| 17.0 | 80.0 |
| 23.0 | 85.7 |
| 26.0 | 82.7 |
| 42.0 | 83.0 |

The aluminum-lithium-beryllium alloy so obtained, after a solutionizing heat treatment of ½ hour at 538° C., water quenching and aging for 8.5 hours at 175° C. had the following mechanical properties: 96.4 GPa elastic modulus, 483.4 MPa yield strength, 510.0 MPa ultimate tensile strength and 2.3% elongation. In Table 2 are the specific mechanical properties of this alloy compared to some aluminum-lithium binary powder metallurgy alloys.

TABLE 2

| | Al—3.6Li—9.8Be | Al—2.7Li[1] | Al—4.5Li[2] |
|---|---|---|---|
| E/δ (kNmg$^{-1}$) | 41.2 | 31.5 | 39.6 |
| YS/δ (Nmg$^{-1}$) | 206 | 152 | 137 |
| UTS/δ (Nmg$^{-1}$) | 218 | 185 | 140 |

[1]Chellman, D., Wald, G., "Age Hardening of Al—Li—Cu—Mg—Zr PM Alloys", Proceedings of 1982 Nat. Powder Metallurgy Conference, Montreal, Canada (1982).
[2]Webster, D., Lockheed Missiles and Space Co., Inc., LMSC-D630733, Independent Research (1978).

EXAMPLE 3

An alloy containing 2.8 wt. % Li, 0.4 wt. % Be balance Al was prepared following the procedures indicated in Example 1. The alloy exhibited a density of 2.475 g/cm$^3$ and a microstructure consisting of an age hardenable, aluminum-lithium matrix having a uniform dispersion of fine Be-rich particles of submicron size, mostly below 0.5 μm in diameter. This microstructure was noticeably different to the one obtained in alloys with high concentrations of Be in which the Be second phase (U.S. Pat. No. 3,644,889) is present as a coarse interconnected network. After a solutionizing heat treatment at 538° C. for ½ hour, water quenching and aging at 190° C., the alloy showed changes in hardness representative of the precipitation of $Al_3Li$(δ') as indicated in Table 3.

TABLE 3

| Rockwell B Hardness (Aged at 190° C.) | |
|---|---|
| Time (Hours) | Hardness ($R_B$) |
| 1 | 48.0 |
| 7 | 61.0 |
| 11 | 67.3 |
| 15 | 71.3 |
| 22 | 73.7 |
| 31 | 73.7 |

TABLE 3-continued

| Rockwell B Hardness (Aged at 190° C.) | |
|---|---|
| Time (Hours) | Hardness ($R_B$) |
| 54 | 68.7 |

We claim:

1. Aluminum base alloys consisting essentially of 0.5 to 4.3 weight percent lithium, 0.02 to 20 weight percent beryllium with the remainder being aluminum, said alloys exhibiting a microstructure consisting of an age hardenable, aluminum-lithium matrix having a uniform dispersion of fine beryllium-rich particles of submicron size.

2. An alloy in accordance with claim 1 wherein said beryllium is present in an amount of 0.02 to 10 weight percent.

* * * * *